US011091360B2

(12) United States Patent
Christiansen

(10) Patent No.: US 11,091,360 B2
(45) Date of Patent: Aug. 17, 2021

(54) BEVERAGE DISPENSING SYSTEM INCLUDING SINGLE USE COLLAPSIBLE KEGS

(71) Applicant: Carlsberg Breweries A/S, Copenhagen (DK)

(72) Inventor: Jonas Christiansen, København (DK)

(73) Assignee: Carlsberg Breweries A/S, Copenhagen (DK)

( * ) Notice: Subject to any disclaimer, the term of this patent is extended or adjusted under 35 U.S.C. 154(b) by 0 days.

(21) Appl. No.: 16/969,004

(22) PCT Filed: Feb. 13, 2019

(86) PCT No.: PCT/EP2019/053509
§ 371 (c)(1),
(2) Date: Aug. 11, 2020

(87) PCT Pub. No.: WO2019/158562
PCT Pub. Date: Aug. 22, 2019

(65) Prior Publication Data

US 2021/0024341 A1 Jan. 28, 2021

(30) Foreign Application Priority Data

Feb. 13, 2018 (EP) ..... 18156533

(51) Int. Cl.
*B67D 1/04* (2006.01)
*B67D 1/08* (2006.01)
*B67D 1/12* (2006.01)

(52) U.S. Cl.
CPC ..... *B67D 1/0462* (2013.01); *B67D 1/0801* (2013.01); *B67D 1/0857* (2013.01); *B67D 1/0884* (2013.01); *B67D 1/0888* (2013.01); *B67D 1/1225* (2013.01); *B67D 2001/0828* (2013.01); *B67D 2210/00104* (2013.01)

(58) Field of Classification Search
CPC .. B67D 1/0462; B67D 1/0801; B67D 1/0857; B67D 1/0884; B67D 1/0888; B67D 1/1225; B67D 2001/0828; B67D 2210/00104
See application file for complete search history.

(56) References Cited

U.S. PATENT DOCUMENTS 4,800,492 A 1/1989 Johnson et al.
4,827,426 A 5/1989 Patton et al.
8,677,721 B2 3/2014 Piana
(Continued)

FOREIGN PATENT DOCUMENTS

CN 103429500 A 12/2013
DE 3511224 A1 10/1986
(Continued)

*Primary Examiner* — Donnell A Long
(74) *Attorney, Agent, or Firm* — BakerHostetler

(57) ABSTRACT

A beverage dispensing system (10) for dispensing a beverage stored in a single use collapsible beverage container (18) including a measuring device (50) for at least retrieving information about the beverage and/or the single use collapsible beverage container (50), and including an electronic sensor (48) device for reading said information from said measuring device (50), thereby establishing digital data representing said information about said beverage and/or said collapsible beverage container (18).

20 Claims, 6 Drawing Sheets

(56) References Cited

U.S. PATENT DOCUMENTS

| | | | | |
|---|---|---|---|---|
| 2005/0087255 | A1* | 4/2005 | Humphrey | B67D 1/1236 141/94 |
| 2009/0057347 | A1* | 3/2009 | Leys | B67D 1/0462 222/386.5 |
| 2010/0036528 | A1* | 2/2010 | Minard | B67D 1/10 700/265 |
| 2010/0089943 | A1* | 4/2010 | Till | B67D 3/0006 222/1 |
| 2010/0133292 | A1* | 6/2010 | Ware | B67D 7/763 222/1 |
| 2011/0000923 | A1* | 1/2011 | Morales | B67D 1/0804 220/673 |
| 2011/0062183 | A1* | 3/2011 | Wiemer | B67D 1/0462 222/95 |
| 2011/0259776 | A1 | 10/2011 | Chen | |
| 2012/0059513 | A1 | 3/2012 | Perkins et al. | |
| 2013/0054257 | A1* | 2/2013 | Holman | G07F 17/0064 705/2 |
| 2014/0368318 | A1 | 12/2014 | Simmons et al. | |
| 2015/0354886 | A1 | 12/2015 | Sinko | |
| 2016/0023879 | A1* | 1/2016 | Walker | B67D 1/0041 141/9 |
| 2016/0194192 | A1 | 7/2016 | Grottini | |
| 2016/0257551 | A1* | 9/2016 | Cohen | F04B 15/02 |
| 2017/0096322 | A1 | 4/2017 | Volftsun | |
| 2017/0096323 | A1 | 4/2017 | Deraedt et al. | |
| 2017/0099981 | A1 | 4/2017 | Feghali et al. | |
| 2017/0253473 | A1* | 9/2017 | Melville, Jr. | B67D 3/0019 |
| 2017/0291808 | A1 | 10/2017 | Young et al. | |
| 2020/0109042 | A1* | 4/2020 | Jacobsen | A47J 31/521 |
| 2020/0247654 | A1* | 8/2020 | McIntyre | B67D 1/0437 |

FOREIGN PATENT DOCUMENTS

| | | | |
|---|---|---|---|
| EP | 3006394 | A1 | 4/2016 |
| EP | 3239093 | A1 | 11/2017 |
| WO | 2004/096694 | A1 | 11/2004 |
| WO | 2006/036863 | A1 | 4/2006 |
| WO | 2006/066787 | A1 | 6/2006 |
| WO | 2007/146892 | A2 | 12/2007 |
| WO | 2009/032874 | A2 | 3/2009 |
| WO | 2009/064844 | A2 | 5/2009 |
| WO | 2010/075918 | A1 | 7/2010 |
| WO | 2011/002295 | A1 | 1/2011 |
| WO | 2012/010659 | A1 | 1/2012 |
| WO | 2012/097403 | A1 | 7/2012 |
| WO | 2012/102759 | A1 | 8/2012 |
| WO | 2015/066594 | A1 | 5/2015 |
| WO | 2016/168220 | A1 | 10/2016 |

* cited by examiner

BEVERAGE DISPENSING SYSTEM INCLUDING SINGLE USE COLLAPSIBLE KEGS

CROSS-REFERENCE TO RELATED APPLICATIONS

This application is the National Stage of International Patent Application No. PCT/EP2019/053509 filed Feb. 13, 2019, which claims the benefit of European Patent Application No. 18156533.4 filed Feb. 13, 2018, the disclosure of which is incorporated herein by reference in its entirety for any and all purposes.

The present disclosure relates to system and method for dispensing a beverage stored in a single use collapsible beverage container and measuring several properties or parameters of the beverage and/or the collapsible beverage container. The present disclosure relates also to measuring the amount of remaining beverage in the single use collapsible beverage container. And the present disclosure also relates to a single use collapsible beverage container for use in the presently disclosed beverage dispensing system.

BACKGROUND

Beverage dispensing systems are typically used in beverage dispensing establishments for efficiently dispensing large quantities of beverage. Typically, beverage dispensing systems are used to dispense carbonated alcoholic beverages such as draught beer and cider. However, also non-alcoholic beverages such as non-alcoholic beers, soft drinks and non-carbonated beverages such as wine and fruit juice may be dispensed using a beverage dispensing system. Beverage dispensing systems are mostly for professional users such as in establishments like bars, restaurants and hotels, however, increasingly also for private users such as in private homes.

Professional beverage dispensing systems typically dispense beverage provided in large beverage kegs. Such beverage kegs may for instance hold 20-50 L of beverage for a professional beverage dispensing system for allowing typically 50-100 beverage dispensing operations before needing to exchange the beverage keg. Typically, beverage kegs are made of solid materials such as steel and re-filled a number of times. In between each filling, the beverage kegs are carefully cleaned. Insufficient cleaning may lead to unhygienic beverage kegs, which may in turn lead to health problems for the beverage consumer. While there exist beverage kegs made of plastic such as PET for single use, such beverage containers are not collapsible during operation. Nowadays, beverage kegs are made collapsible and for single use only, at least partly due to the above hygiene concern.

Such beverage dispensing systems using collapsible beverage kegs can have the beverage keg installed or placed in a pressure chamber. Thus, while there is a need to pressurize conventional steel kegs with $CO_2$, for instance by means of a $CO_2$-cartridge connected to the keg during dispensing, single use beverage systems such as the applicant's DraughtMaster™ uses air from a pressure source, e.g. an air compressor, to push the beer out and collapsing the keg, which means that nothing touches the beer from when it leaves the brewery until it goes in the beverage recipient, e.g. beer glass. Accordingly, the beverage stored in such collapsible beverage container is pre-carbonized or pre-mixed with nitrogen when dispensing English type beer such as ales and stouts. When dispensing the beverage, the pressure fluid e.g. compressed air, is allowed to enter the pressure chamber, causing the beverage keg to collapse while dispensing the beverage. The volume of the beverage keg is reduced corresponding to the amount of dispensed beverage. The collapsible beverage kegs are preferably made of flexible and disposable material such as plastic.

While performing a dispensing operation, the pressure applied causes the beverage to flow out of the collapsible beverage container and into a tapping line. The tapping line leads to a tapping device comprising a tapping head having a beverage dispensing control means, such as a tap handle, and a spout for dispensing beverage into a beverage recipient. The tapping head includes typically also a tapping handle for allowing an operator to control the tapping valve and thereby the beverage dispensing operation. The operator, such as a bartender or barmaid, uses the tapping handle to control the dispensing of beverage. Typically, the tapping head is a part of a font mounted in a bar counter.

In many cases, it may be difficult to determine the flow of beverage through the dispensing device as well as the volume of remaining beverage in the beverage container. It would be desirable to avoid the use of measurement devices that are in contact with the beverage, as such devices must either be disposable or be cleaned at regular intervals. It would also be desirable to be able to use a simple means to establish the volume of remaining beverage in collapsible beverage containers.

It would also be desirable to be able to acquire certainty about the origin of a single use and collapsible beverage container to ensure quality by avoiding using beverage containers from undesired sources.

The establishing and storing of various forms of digital data has been increasingly popular during the 21$^{st}$ century. Not only within the technical field of computing, but in everyday affairs such as shopping, driving and operating some household equipment it may nowadays be possible to input and extract digital data.

In draught beverage systems so far, there has been limited such development; however, using digital technologies also in draught beverage systems may simplify the operation, avoid human errors and increase quality control as well as cleaning of the tapping line as e.g. disclosed in co-pending European patent application 17198816.5. In particular, such development has not emerged in single use and collapsible beverage containers.

It is therefore a purpose of the present invention to provide technologies for being able to measure the flow of beverage through the dispensing device as well as the amount of remaining beverage in the beverage container.

It is a further purpose of the present invention to provide technologies for quickly identifying and correcting any misalignment of a given property or parameter in the beverage in the dispensing device with respect to desired levels of such property or parameter.

It is yet a further purpose of the present invention to provide technologies for quickly identifying the origin of a single use collapsible beverage container.

In the following passages, relevant prior art is presented:

U.S. Pat. No. 8,677,721 B1 relates to an apparatus for marking PET containers and a checking device, which checks for the presence of the marking on the containers.

WO 2012/097403 A1 relates to a formula dispensing unit. An optical sensor is used for detecting bottles depending on the material of the bottle.

US 2011/0259776 A1 relates to a packing bag with an RFID function.

WO 2010/075918 A1 relates to a method for testing bottles by means of an optoelectronic sensor system for intactness of the original security ring.

WO 2006/066787 A1 relates to a container with a transponder.

U.S. Pat. No. 4,827,426 A relates to a data acquisition and processing system for a post-mix drink dispenser.

U.S. Pat. No. 4,800,492 A relates to a data logger for a post-mix beverage dispensing system in a fast food restaurant.

US 2017/0096322 A1 and WO 2016/168220 A1 both relate to a system for dispensing keg wine having, in combination: integrated temperature control; pressure monitoring; automated purging; and integrated point of sale data acquisition for determining inventory usage statistics for each keg of wine dispensed.

US 2014/0368318 A1 relates to a system for monitoring the distribution of a disinfectant having an expiration. The system uses containers and a reader of the system can read identifiers associated with the containers. RFID is mentioned.

US 2017/099981 A1 relates to a machine including a family of smart coffee dispensing machines that is connected 24/7 to the cloud.

US 2016/194192 relates to a combination between a dispenser and at least a case of a plurality of containers. It mentions a wireless communication system for the exchange of data between said case and said dispenser.

WO 2009/064844 A2 relates to a beverage distribution system for the purpose of self-service beverage dispensing, capable of providing customers real-time feedback on beverage consumption levels.

WO 2012/102759 A1 (CN103429500A) relates to an integrated circuit mounted on the container or opening mechanism to determine the sealing status of the container.

WO 2015/066594 A1 relates to a supply chain system for monitoring fluid levels in conventional steel kegs. Embodiments include sensors that fit within a keg's false bottom, measure the weight of the keg, and transmit the weight information to a computer database via a wireless network. Other embodiments include an RFID device with information about a characteristic of the liquid within a keg. Multiple containers in close proximity may each be fitted with an RFID device and sensor and communicate their individual information to the database.

WO 2012/010659 relates to a volumetric measuring of the contents of draught beer in a keg and discloses a measuring device in the form of an electronic sensor or pressure switch, which measures the pressure inside the collapsible beverage container or the beverage inside the collapsible beverage container. The base part or lid includes an electronic sensor device in the form of a control unit for reading the information from the above measuring device. However, this document is silent about the provision of a measuring device in the form of a digital identifier, e.g. RFID-tag, in the collapsible beverage container.

US 2017/291808 relates to a beverage dispensing system where the beverage is wine and which comprises a canister containing a collapsible beverage container. An identifier such as e.g. an RFID-tag is provided in the canister to identify the amount of beverage (wine) in the canister. Scanning or reading means to detect said identifier are also provided in the dispensing system. However, this document is also silent about the provision of a digital identifier (e.g. RFID-tag) in the collapsible beverage container itself.

SUMMARY OF INVENTION

A first aspect of the present relates to a beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space. In a first embodiment said beverage dispensing system comprises:

- a base part adapted to cooperate with a beverage container connector for connecting to said beverage outlet of said collapsible beverage container,
- a tapping device comprising one or more tapping heads for extracting said beverage from said beverage filled space,
- a tapping line extending from said beverage container connector to said tapping device, said tapping line comprising one or more beverage lines, and
- a lid connectable to said base part, said lid and said base part defining a sealed inner space for accommodating and encapsulating said collapsible beverage container.

A pressure source may further be provided in fluid communication with said inner space for pressurizing said inner space for applying a force onto said collapsible beverage container, collapsing said collapsible beverage container and forcing said beverage from said beverage filled space through the tapping line and out through the tapping device.

In one embodiment the collapsible beverage container includes a measuring device for at least retrieving information about said beverage and/or said collapsible beverage container. Correspondingly the base part and/or the lid may include an electronic sensor device for reading the information from said measuring device, thereby establishing digital data representing said information about said beverage and/or said collapsible beverage container.

In the preferred embodiment the measuring device is in the form of a digital sensor/identification tag, e.g. a wireless electronic device, preferably an RFID/NFC-tag. The measuring device may also be the form of a visible identifier, such as a bar code, or combinations thereof.

Hence, information in terms of the properties or parameters of the beverage and/or the collapsible beverage container, including content of beverage in said collapsible beverage container, can be measured and thereby identified. The retrieved information from a measuring device is then stored, read, and optionally processed by the electronic sensor device, preferably a digital sensor device, included in the base part and/or the lid.

The type of the beverage may be stored or an identification for a database with other information about the beverage, e.g. whether the beverage is a beer, a specific beer type, soda or other, the name of the beverage as well as other information relevant to the user or customer such as the date and/or origin of production, alcohol percentage if applicable, etc. The information may then be displayed automatically at for instance the tapping head. The beverage container information may also relate to the volume of the container. This will allow the beverage dispensing system to be informed about the initial volume of the container in order to deduce the remaining volume by means of flow measurements. In particular, RFID/NFC tags or bar codes may store some or all of this information in a convenient way.

Said collapsible beverage container is preferably a single use collapsible beverage container. The terms "single use collapsible beverage container" or "single use collapsible keg" are used interchangeably throughout this disclosure. Suitably, it can be blow-molded and preferably having a volume between 5-50 liters which is constituted by a beverage filled space defined by the beverage and a gas filled head space which typically is carbon dioxide. The collapsible beverage container contains a beverage outlet, which is closed off during transport and handling. The collapsible keg, instead of utilizing a plastic material such as PET, may use a multilayer foil.

The use of digital technologies such as use of RFID-tags is known for steel kegs due to the large investment associated with such steel kegs. They are re-usable; hence they need to be properly cleaned, transported and of course re-used, thus triggering a need for controlling among other things their whereabouts. Yet by the present invention, it has been found that beverage systems comprising single use collapsible kegs may be provided with a measuring device, such as an RFID-tag, despite the disposal of the keg after use, i.e. after the beverage has been dispensed. Thus, an apparently unnecessary cost and operational burden is added, yet it enables among other things that the connector (beverage container connector) and the single use collapsible keg fit together. This ensures that these kegs have the required quality and are not simply coming from unreliable sources, which is highly important, not least for safety reasons. RFID-tags will recognize that the connector and keg fit together; if not, the beverage system shuts down by e.g. not providing the required pressure for dispensing the beverage. Hence, in a further embodiment the presently disclosed system and method may be configured such that data read from the identification must be in a specific format and/or must contain a predefined security code, and/or the production data of the beer cannot be too old, e.g. less than one, two, three or six months, otherwise tapping from the specific keg and/or the entire system is not possible, e.g. by blocking a valve or not providing the required pressure, etc., thereby ensuring a consistently high quality of the beverage.

When installed in a beverage dispensing system like the applicant's DraughtMaster™, the beverage container is typically oriented in a predetermined position such as an "upside down" position, i.e. the beverage outlet is oriented in a downward direction so that the head space is thereby oriented in an upwards direction. The base part is typically rigid and suitable for supporting the weight of the beverage container, and the beverage container connector forms a fluid-tight connection between the beverage outlet and the tapping line.

The tapping head comprises at least one tapping valve, which is controlled by a beverage dispensing control means, such as a pushing button or preferably a tapping handle. A user wishing to dispense beverage will for example move the handle from a vertical position to a horizontal position and thereby operate and open the valve for allowing a flow or stream of beverage from the beverage filled space via the tapping line to the tapping head.

The lid is connectable to the base part in a fluid-tight fashion in order to be able to form a hermetically sealed inner space, which has a suitable volume for encapsulating the beverage container.

The base part is made of rigid material in order to support the collapsible beverage container. In the context of the present patent application, rigid material should be understood as being capable of supporting the weight of the beverage without bulging. Pressure is applied to the collapsible beverage container in order to apply a dispensing pressure for forcing the beverage from the beverage filled volume via the tapping line to the tapping head when the tapping valve is open as a result of the tapping handle being moved from its original vertical (close) position. The pressure should be sufficiently great to overcome the crumpling pressure of the collapsible beverage container plus the gas pressure of brewage, i.e. the pressure required for collapsing the beverage container, and as well overcome the pressure losses in the dispensing line, e.g. for elevating the beverage from a cellar located below a bar. Finally, a certain pressure at the tapping head is required for allowing a suitable flow velocity, however, too much flow or too small pressure may cause undesired foaming.

The term "a measuring device" means one or more measuring devices.

Said measuring device is in the form of an analogue sensor, a digital sensor or combinations thereof. An analogue sensor, such as a sensor retrieving information of the pressure within the sealed inner space, may then convert the information retrieved into digital information, such as a digital signal. The measuring device may also be a digital sensor. A combination of these, i.e. a plurality of measuring devices is also possible; a measuring device may be included in said lid, another in the collapsible beverage container and a third measuring device in the tapping line, as it will become apparent from the embodiments below and the figures.

According to the first aspect of the invention, the measuring device is in the form of a digital sensor, wherein the digital sensor is a wireless electronic device, preferably an RFID-identifier (Radio Frequency Identification tag) or a NFC-identifier, or the measuring device is in the form of a visible identifier, such as a bar code, or combinations thereof. As used herein the term "visible identifier" means that the identifier is able to be recognized optically, for instance by a scanner. RFID-tags and NFC-tags are adapted to at least retrieving information of for instance what type of beer or brand that is contained within a collapsible beverage container. By the term "at least retrieving information" is meant that not only retrieving information is possible, but also storing information and optionally also processing information. As used herein, the term "retrieving" means receiving. NFC- and RFID-tags in particular, also known as RFID-chips may retrieve (i.e. receive), store and process information, in particular store and process information e.g. transmit information, here of the beverage and/or the collapsible beverage container. As is well-known in the art, RFID enables uniquely identifying items using radio waves. The NFC/RFID system comprises a reader and a tag. The reader sends a radio frequency signal to the tag via an antenna, and the tag responds with its unique information.

According to an embodiment of the first aspect, said digital sensor device for reading said information from said measuring device, is an RFID-reader, a bar code reader, or combinations thereof. Preferably said digital sensor device for reading said information from said measuring device is an RFID-reader.

In a particular embodiment of the first aspect, the beverage container includes a digital identifier, such as an NFC/RFID tag, which is readable by an NFC/RFID sensor in the pressure chamber or any other suitable location in the beverage dispensing system. The pressure chamber comprises the lid and base part.

Suitably, a measuring device may be provided for measuring the resonance frequency after a perturbation of the pressure chamber or the collapsible beverage container, thus enabling useful information about the status of the pressure chamber and the keg itself, thereby increasing safety of the beverage dispensing system. As used herein, the pressure chamber includes the lid. Suitably also, a measuring device for measuring the flow of gas in the pressure shell is provided.

According to an embodiment of the first aspect, said collapsible beverage container includes a closure adapted to cooperate with said beverage container connector, wherein an identification tag, e.g. NFC or RFID-tag, is mounted on the rim of said closure, sealing of said closure, or internally in said closure, and optionally the NFC/RFID-reader is mounted on the base part adjacent to said closure. By "internally in said closure" is meant at the internal face of said closure, thus the identification tag is mounted in a less visible location. Hence, the present disclosure further relates to a collapsible beverage container, preferably single use, for use in the presently disclosed beverage dispensing system, said collapsible beverage container comprising a closure and an identification tag, such as a NFC/RFID tag and/or a barcode. The closure is preferably configured to cooperate and/or engage with the beverage container connector disclosed herein. The ID tag may be mounted on the rim of said closure, sealing of said closure, or internally in said closure. One or more visible bar codes may be printed or attached on the rim, closure and/or body of the collapsible beverage container.

A further embodiment relates to a collapsible beverage container for use in presently disclosed beverage dispensing system, the collapsible beverage container comprising a collapsible body and a closure with a beverage outlet configured for engagement with the beverage container connector of the beverage dispensing system, the collapsible beverage container further comprising at least one identification tag mounted on a rim of said closure, a sealing of said closure or internally in said closure, and/or on the body of said container, said identification tag readable by a corresponding reader in the beverage dispensing system. As stated above the identification tag may be a radio frequency identification tag, such as RFID/NFC, a visible/optical tag, such as a barcode, or a combination thereof. The identification tag may comprise identification information for uniquely identifying said container. The identification tag may further comprise information selected the group of: type of the beverage, producer of beverage, origin of beverage, production date of beverage, production place of beverage and shipping date of beverage. And the identification tag may further comprise at least one of one or more predefined codes for approval by the beverage dispensing system.

The present disclosure further relates to a kit of parts of the presently disclosed beverage dispensing system and the presently disclosed collapsible beverage container. The beverage dispensing system may be configured such that tapping of beverage from said collapsible beverage container is only possible if a predefined match between ID tag of the container and ID reader of the beverage dispensing system is achieved.

The provision of an identification tag enables identification of the keg and improved inventory management, as already discussed above and further explained below. The ID tag may be mounted prior to filling a single use collapsible keg so that after filling, the tag is logged centrally, a production label is written to the tag and/or ID from the tag is correlated in a database or data logging system with all information. Inventory management is improved, since each collapsible keg has a unique ID, i.e. identification concerning what, when and where it is produced, as well as when it is shipped, to whom, when it is emptied or opened, etc. In addition, each serving incident on the system can be logged to the specific tag and unknown tags may be identified and if necessary, rejected. The beverage dispensing system according to this embodiment optionally comprises an RFID-reader, e.g. a high frequency RFID-reader such as NFC (Near-Field Communication) reader, mounted preferably on the base part adjacent to said closure.

By the term "adjacent" in this embodiment is meant that the RFID-reader, e.g. NFC reader is mounted on the outside of the base part at a non-touching distance of the closure of the collapsible beverage container. When pressure is applied and is above say 2 bar, the tag reader is activated and initiates a reading-process of the ID-tag mounted on the rim or sealing of the closure. ID and timestamp comprising data on when this takes place is recorded and communicated to a data logging system for retrieving and storing said data. When pressure is released, i.e. decreases below e.g. 2 bar, the ID-reader is reactivated and a new timestamp is created for the collapsible beverage container. This embodiment is particularly suitable when using modular systems, i.e. a plurality of collapsible beverage containers sharing a common tapping line.

The presently disclosed approach enables quickly identifying and correcting any misalignment of a given property or parameter in the beverage in the beverage dispensing system. For instance, if a device of the beverage dispensing system in a bar has a failure, the technician being located far from the bar becomes immediately aware of the issue and thus may arrive within a few minutes to fix the failure, hence reducing significantly any downtime period. As a particular example, if the beer temperature is decreasing, the technician may become aware of this immediately and quickly arrive at the bar, inspect and fix the cooling device of the beverage dispensing system so that the beer temperature has the desired level. Hence, the invention enables not only use of information stored for use inside a drinking establishment, such as a bar, but also outside the drinking establishment.

According to an embodiment of the first aspect, a cooling device is adapted downstream said beverage connector and upstream said tapping device for cooling said tapping line, and said cooling device further comprises a measuring device in the form of a temperature sensor for measuring the temperature of a cooling line running adjacent said tapping line and which is mounted on said cooling device. Hence, a temperature sensor is affixed the cooling device for obtaining the cooling tube flow temperature so that the temperature is measured at the cooling device. This enables proper serving temperature in instances where the cooling of the tapping line takes place by a separate cooling line running adjacent such tapping line (so-called "wet Python"). The serving temperature of the beverage, when this is a beer, is suitably 3-6° C. This serving temperature ($T_{serv}$) may be calculated as the average of the temperature of the cooling line at the point of leaving the cooling device (T1 in ° C.) and its temperature at the point of entering the cooling device when it is returned (T2 in ° C.), i.e. $T_{serv}=(T1+T2)/2$. Temperature T1 is suitably 3 or 4° C. and since T2 is normally above T1, if T1 is above 6° C., this can immediately be detected as an error message, thus indicating the status of the cooling device and tapping line, here in particular that the cooling device may not be working properly. The measuring device(s) in the form of temperature sensors for measuring the temperature of the tapping line may also be mounted on the cooling device. Suitably, a measuring device is adapted to a specific beverage line within the tapping line.

In another embodiment of the first aspect, a cooling device is adapted downstream said beverage connector and upstream said tapping device for cooling said tapping line, wherein said tapping line includes a measuring device in the form of a temperature sensor and the measuring device is mounted in the tapping line in close proximity to said tapping device. By close proximity is meant the measuring device being mounted within the last 30%, preferably the last 20%, more preferably the last 10% of the length of the tapping line, measured from the cooling device and until the tapping head of the tapping device, e.g. until the beverage dispensing control means, such as the tapping handle. This enables proper serving temperature in instances where the cooling of the beverage line takes place without the use of a cooling line running adjacent the beverage line (so-called "dry Python"). Where a font is provided, the sensor may be provided inside the font i.e. within the vertical portion of the font, or upstream the font just before the tapping line enters the font underneath the bar counter.

According to an embodiment of the first aspect, the tapping line comprises a plurality of beverage lines, preferably two to five beverage lines, more preferably three beverage lines, each beverage line corresponding to a specific beverage type and adapted to cooperate with a tapping head of the tapping device, each tapping head corresponding to said beverage type, and in which said beverage line includes a measuring device in the form of a flow sensor, temperature sensor, or a combined flow and temperature sensor. A combined flow and temperature sensor is preferred. Suitably this sensor is in the form of black box, e.g. "clamp on" black box, operated by ultrasonic measuring system and including slot for beverage line insertion, e.g. beer tube insertion so that there is no contact with beverage. The combined flow and temperature sensor is preferably adapted to fit not only beverage lines such as beer tubes, but also cooling lines, i.e. cooling tubes.

This combined temperature and flow sensor enables continuous and accurate measurement of the beverage volume flow as beer is dispensed from a tapping head. Thereby, every time the beverage is dispensed, i.e. poured, the amount poured is measured, with an accuracy of about 10 ml per pouring. At the same time, the temperature of the beverage with an accuracy of about 0.5° C. is possible, thus rendering immediate information on the beverage about to be dispensed. Furthermore, timestamps providing information regarding an event, such as when a given amount of beverage was dispensed, are also possible.

According to an embodiment of the first aspect, the base part includes a weighing device, preferably a digital weighing device, for continuously weighing the beverage container during dispensing and establish digital data representing a weight of the beverage container and a flow of beverage through the tapping device deduced via the weight. By continuously weighing the beverage container during dispensing, the loss in weight may be considered to correspond to the flow of beverage. In case the original volume of beverage is known, or alternatively in case the weight of the container without beverage is known, the amount of remaining beverage in the beverage container may be deduced using standard arithmetic. Hence, a simple and straightforward way of measuring the flow of beverage is provided, without resorting to expensive means for detecting the level of beverage in the collapsible container.

Digital technologies are preferred since data processing is much easier. A dynamic consumption feedback via dynamic view of the contents of the collapsible beverage container (collapsible keg) is possible, so that the staff and the manager of the drinking establishment are continuously informed. For instance, a keg in a beverage dispensing system comprising a plurality of collapsible kegs may provide information to the staff or bartenders as well as a manager of a first keg having a certain type of beer A and how much the keg is filled with a beverage, e.g. a beer, say beer type A keg 60% filled. At the same time, information is also provided about the second keg, which may have another beer type B and is 80% filled, and about a third keg having a third beer type C with the keg being filled 10%. Such information suitably represented as:

Beer A, 60%
Beer B, 80%
Beer C, 10% may be displayed via a wireless connection such as Bluetooth or WiFi connection to a Tablet or smartphone or similar. Reordering of beer with suppliers may then be made automatically when defined low quantity of beer in keg is reached.

According to an embodiment of the first aspect, the beverage dispensing system comprises: a first pressure sensor for continuously measuring a first pressure within the inner space during dispensing, a second pressure sensor for continuously measuring a second pressure at the tapping device during dispensing, and a digital processing unit for establishing digital data representing a flow of beverage from the beverage filled space through the tapping device deduced via the first pressure and the second pressure.

This embodiment may also comprise a third pressure sensor for continuously measuring the pressure inside said beverage container. For instance, this pressure sensor may be adapted to measure the pressure at the tapping line at the outlet of the collapsible beverage container. The pressure difference between this pressure and the pressure within the inner space can be tracked. Because of the height of the beverage within the collapsible beverage container, the pressure at the bottom will be higher while there is still beverage therein to be dispensed.

The pressure difference between the inner space and the tapping device or the pressure difference between inside the beverage container and the tapping device corresponds to the driving pressure forcing the beverage from the beverage container to the tapping device. A correction may be made taking into account the crumpling pressure of the beverage container. Using Bernoulli's principles, the flow of beverage may be deduced. By using both of the above principles, i.e. pressure sensors and weighing device, at the same time, an even more accurate result may be established.

In one embodiment, any of the first, second and third pressure sensors comprises a piezo-electric sensor. Piezo-electric sensors form compact and accurate pressure sensors.

According to an embodiment, the invention also encompasses the beverage dispensing system of the first aspect, wherein said tapping head includes a beverage dispensing control means and a spout for dispensing beverage into a beverage recipient, wherein said tapping head is part of a beverage font, said beverage font being mounted in a bar counter, said bar counter defining an operator side and a customer side opposite said operator side, said beverage dispensing system further including a measuring device in the form of a non-contact measuring device which is integrated in said beverage font and is adapted to detect a parameter or property, such as the temperature, of said beverage recipient. By non-contact measuring device is meant a measurement device which is located at a significant distance from the object being measured, and hence does not touch the object. This distance is 5-200 cm, for instance 5-100 cm, or 10-30 cm.

In one embodiment, said non-contact measuring device is a digital sensor in the form of an infrared sensor (IR). An IR-sensor integrated in the font sends a signal or beam onto the object being measured, this object in particular being the beverage recipient, e.g. beverage glass. This enables reading a spot-surface temperature of the beverage recipient. In addition, a visual indication on the font may be provided for visualizing the reading if outside of an acceptable range of 3-6° C. when using a beer glass.

According to an embodiment of the first aspect, the beverage dispensing system includes a data logging system for receiving and storing the digital data. The data received about the flow of beverage and/or remaining volume as well as other information of the beverage and/or collapsible beverage container may be stored in a data logging system in order to optimize the beverage dispensing system with regard to dispensing pressures, beverage temperatures, etc. Further, the data may be used to establish statistics about beverage consumption.

The lid is preferably flexible and made of an elastic material such as rubber or alternatively said lid is flexible and is made of a non-elastic flexible material such as plastic. Flexible in the context of the present patent application is understood to mean that it is made of a material, which will be deformed when a force is applied to the material, the material will yield and conform to the applied force without breaking.

Most non-rigid materials may be used as a flexible lid. The lid must be fluid-tight, but not able to resist pressure to any significant degree and must thus deform in accordance with the applied pressure. Both elastic materials, such as rubber, and non-elastic flexible material, such as plastic, are feasible. The lid may thus conform to the shape of the beverage container during dispensing.

The beverage dispensing system further comprises a pressure source such as a compressor, e.g. an air compressor, in fluid communication with said inner space for pressurizing the inner space for applying a force onto said collapsible beverage container, collapsing said collapsible beverage container and forcing said beverage from said beverage filled space through the tapping line and out through the tapping device.

The beverage dispensing system may also include a plurality of base parts and a plurality of lids connectable to the base parts. Thus, the present beverage dispensing system may be expanded to an assembly including a plurality of base parts and a plurality of lids. The respective beverage container connectors of the base parts may be interconnected by a common tapping line to form a series connected assembly of collapsible beverage containers; that is, as a modular system.

In one embodiment, the beverage from said beverage filled space of said collapsible beverage container is a beer pre-carbonized or pre-mixed with nitrogen, with the collapsible beverage container preferably being made of a polymeric material such as plastic.

According to a second aspect, there is provided a beverage dispensing system for dispensing a beverage stored in a collapsible beverage container, said collapsible beverage container defining a beverage filled space, a gas-filled head space and a beverage outlet in communication with said beverage filled space for extracting said beverage from said beverage filled space, said beverage dispensing system comprising:

a base part adapted to cooperate with a beverage container connector for connecting to said beverage outlet of said collapsible beverage container, a tapping device comprising one or more tapping heads for extracting said beverage from said beverage filled space, a tapping line extending from said beverage container connector to said tapping device, said tapping line comprising one or more beverage lines, and a lid connectable to said base part, said lid and said base part defining a sealed inner space for accommodating and encapsulating said collapsible beverage container, wherein said tapping head includes a beverage dispensing control means and a spout for dispensing beverage into a beverage recipient, wherein said tapping head is part of a beverage font, said beverage font being mounted in a bar counter, said bar counter defining an operator side and a customer side opposite said operator side, and wherein a measuring device in the form of a non-contact measuring device is integrated in said beverage font and is adapted to detect a parameter or property, such as the temperature, of said beverage recipient.

By non-contact measuring device is meant a measurement device which is located at a significant distance from the object being measured, and thus does not touch the object. This distance is 5-200 cm, for instance 5-100 cm, or 10-30 cm.

In one embodiment according to the second aspect, said non-contact measuring device is a digital sensor in the form of an infrared sensor (IR). An IR-sensor integrated in the font sends a signal or beam onto the object being measured, this object in particular being the beverage recipient, e.g. beverage glass. This enables reading a spot-surface temperature of the beverage recipient. In addition, a visual indication on the font may be provided for visualizing the reading if outside of an acceptable range of 3-6° C. when using a beer glass.

According to an embodiment of the second aspect, the beverage dispensing system includes a data logging system for receiving and storing the digital data. The data received about the temperature of the beverage may be stored in a data logging system in order to optimize the beverage dispensing system with regard to dispensing temperatures, whether there is too much foam in a beer, as this translates into a lower temperature of the beer in glass, etc.

The beverage dispensing system according to the second aspect may be used together with one or more of the other embodiments of the beverage dispensing system in accordance with the first aspect.

According to a third aspect of the present invention, the above-mentioned objects and more are achieved by a method of dispensing a beverage stored in a collapsible beverage container in a beverage dispensing system, said collapsible beverage container defining a beverage filled space, a gas-filled head space and a beverage outlet in communication with said beverage filled space for extracting said beverage from said beverage filled space, the method comprising:

providing a base part including a beverage container connector for connecting to said beverage outlet of said collapsible beverage container, providing a tapping device comprising one or more tapping heads for extracting said beverage from said beverage filled space, providing a tapping line extending from said container connector to said tapping device, said tapping line comprising one or more beverage lines, and providing a lid connectable to said base part, said lid and said base part defining an inner space for accommodating said collapsible beverage container, and accommodating and encapsulating said collapsible beverage container, providing a pressure source in fluid communication with said inner space for pressurizing said inner space for applying a force onto said collapsible beverage container, collapsing said collapsible beverage container and forcing said beverage from said beverage filled space through the tapping line and out through the tapping device, the method further comprising:

installing in said collapsible beverage container a measuring device for at least retrieving information about said beverage and/or said collapsible beverage container, wherein said measuring device is in the form of a digital sensor, and said digital sensor being a wireless electronic device, preferably an NFC- or RFID-tag, said measuring device is in the form of a visible identifier such as a bar code, or combinations thereof, and installing in said base part and/or said lid, an electronic sensor device, preferably a digital sensor device, adapted to at least reading said information from said measuring device thereby establishing digital data representing said information about said beverage and/or said collapsible beverage container.

The method according to the third aspect may be used together with one or more of the embodiments of the beverage dispensing system in accordance with the first aspect.

DETAILED DESCRIPTION OF DRAWINGS

Figure 1:
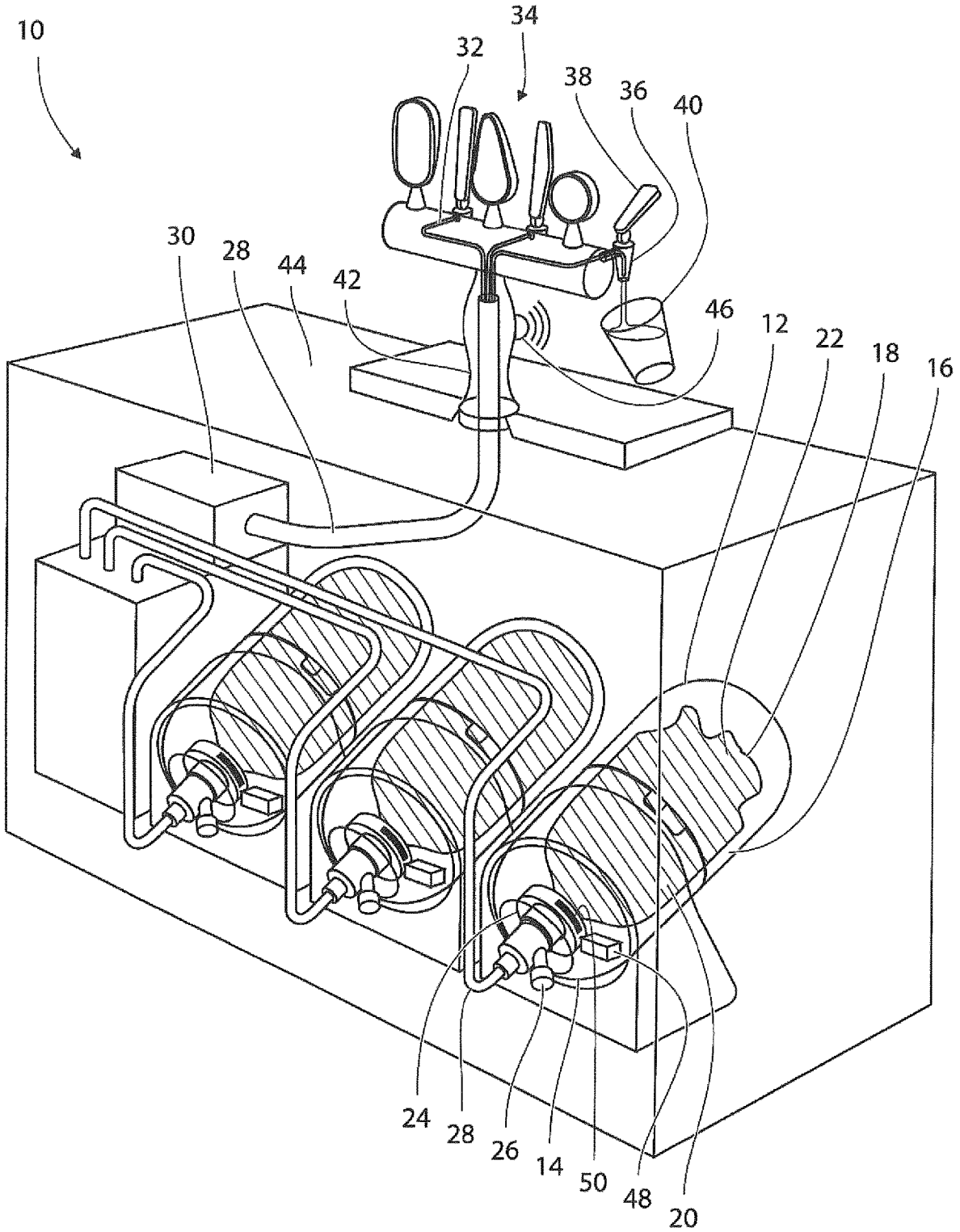
FIG. 1 is a beverage dispensing system as a modular system comprising collapsible beverage filled containers and RFID-system.

FIG. 1 shows a perspective view of a beverage dispensing system 10 having a pressure chamber comprising lid 12 and a rigid base part 14 which are sealed together establishing an inner space or inner volume 16 including a filled single use collapsible beverage container 18. The beverage container 18, also known as keg, is of the collapsible type made of a collapsible polymeric material, thus the term collapsible beverage container. The collapsible beverage container 18 defines a beverage filled space containing the beverage 20, typically being a carbonated beverage such as beer. The beverage container 18 also defines a gas filled head space 22 at its top portion, above the level of the beverage inside the beverage container 18, as better illustrated in FIG. 3.

The lid 12 and the rigid base part 14 are separable but during operation, they are sealed together for defining the inner space 16 for accommodating the beverage container 18. The lid 12 may e.g. be made of rubber. The collapsible beverage container 18 includes a closure 24 adapted to cooperate with a beverage container connector 26 for connecting the beverage outlet (not shown) of the collapsible beverage container 18 with tapping line 28. The tapping line passes through a cooling device or unit 30 in order to provide the beverage with the appropriate serving temperature, e.g. 3-6° C. for beer. Downstream the cooling device 30, the tapping 28 containing one or more beverage lines 32 reaches tapping device 34. The tapping device 34 comprises one or more tapping heads 36, with each tapping head 36 including a tapping handle 38 to dispense beer into beverage recipient (glass) 40. Temperature sensor units (not shown) on the tapping line mounted close to the tapping device, just before reaching the bottom of font 42 or inside the font 42, may be provided to obtain a near serving temperature of the beer when poured in glass 40. The font 42 is mounted on bar counter 44 and the font has integrated an infrared sensor 46 to read a spot-surface temperature of the glass 40.

The closure 24 of the collapsible beverage container 18 includes a digital sensor in the form of an RFID-tag 50 for identification of different properties of the beverage 20 and/or the collapsible beverage container 18, such as the age of the collapsible beverage container and hence its quality, type of beer, volume of beverage remaining, etc. On the outside of the bottom of the pressure chamber, that is in the base part, a digital sensor in the form of an RFID-reader 48 is mounted. When pressure is applied and is above e.g. 2 bar, the RFID-reader 48 is activated and initiates the reading process of the RFID-tag 50. The ID of the collapsible beverage container and timestamp is recorded and communicated to a data logging system (not shown). When pressure decreases to below 2 bar, the reader is reactivated and a new timestamp is created for the collapsible beverage container.

Figure 2:
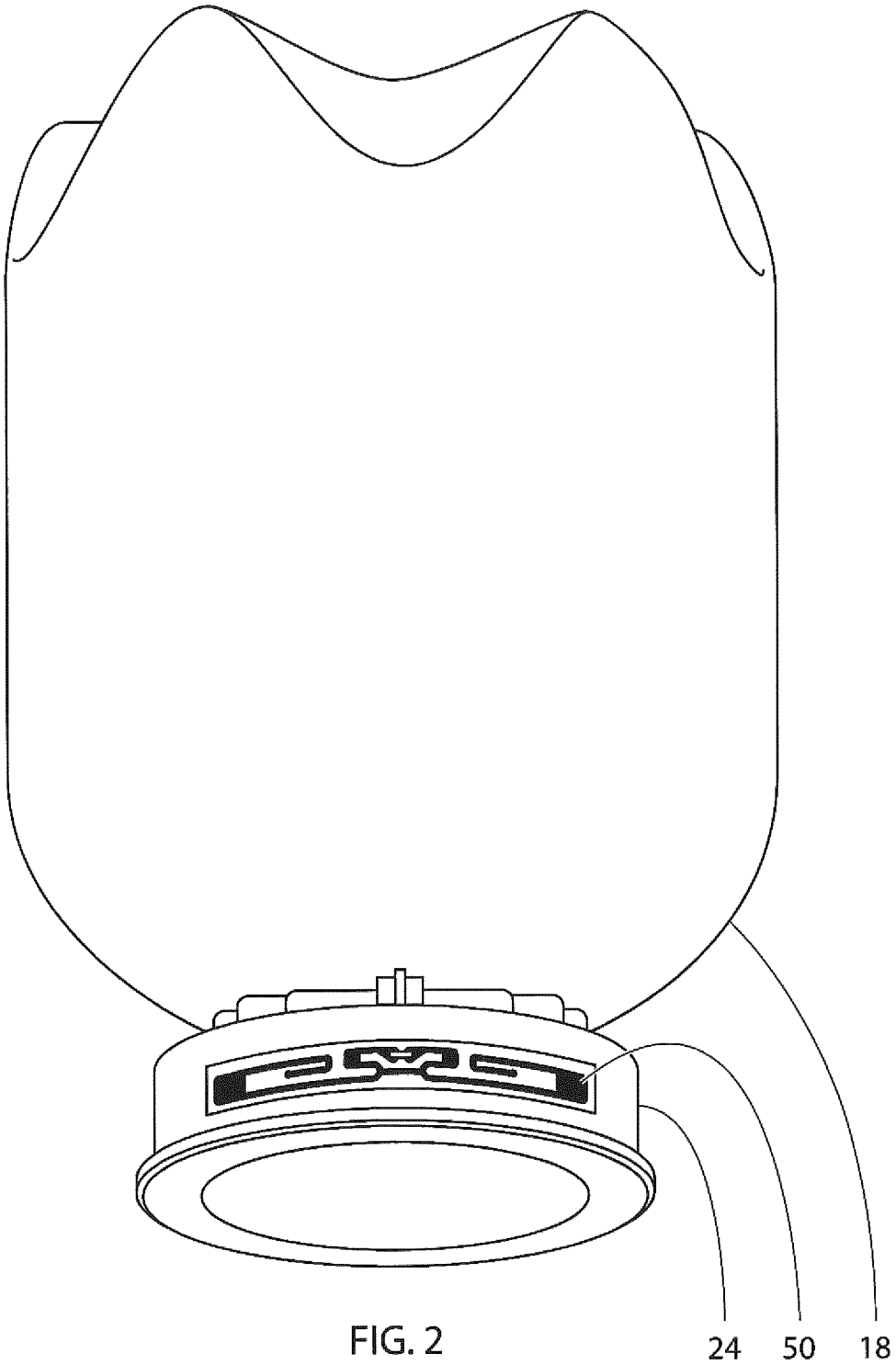
FIG. 2 is an expansion of the bottom portion of a collapsible beverage container of FIG. 1.

FIG. 2 shows an expanded front view of the bottom portion of collapsible beverage container 18 including closure 24 with RFID-tag 50 incorporated therein. The RFID-tag 50 is mounted on the rim of the closure 24. The RFID-tag may also be mounted (installed) in the sealing of the closure 24. The RFID-tag 50 may also be mounted internally in the closure 24.

Figure 3:
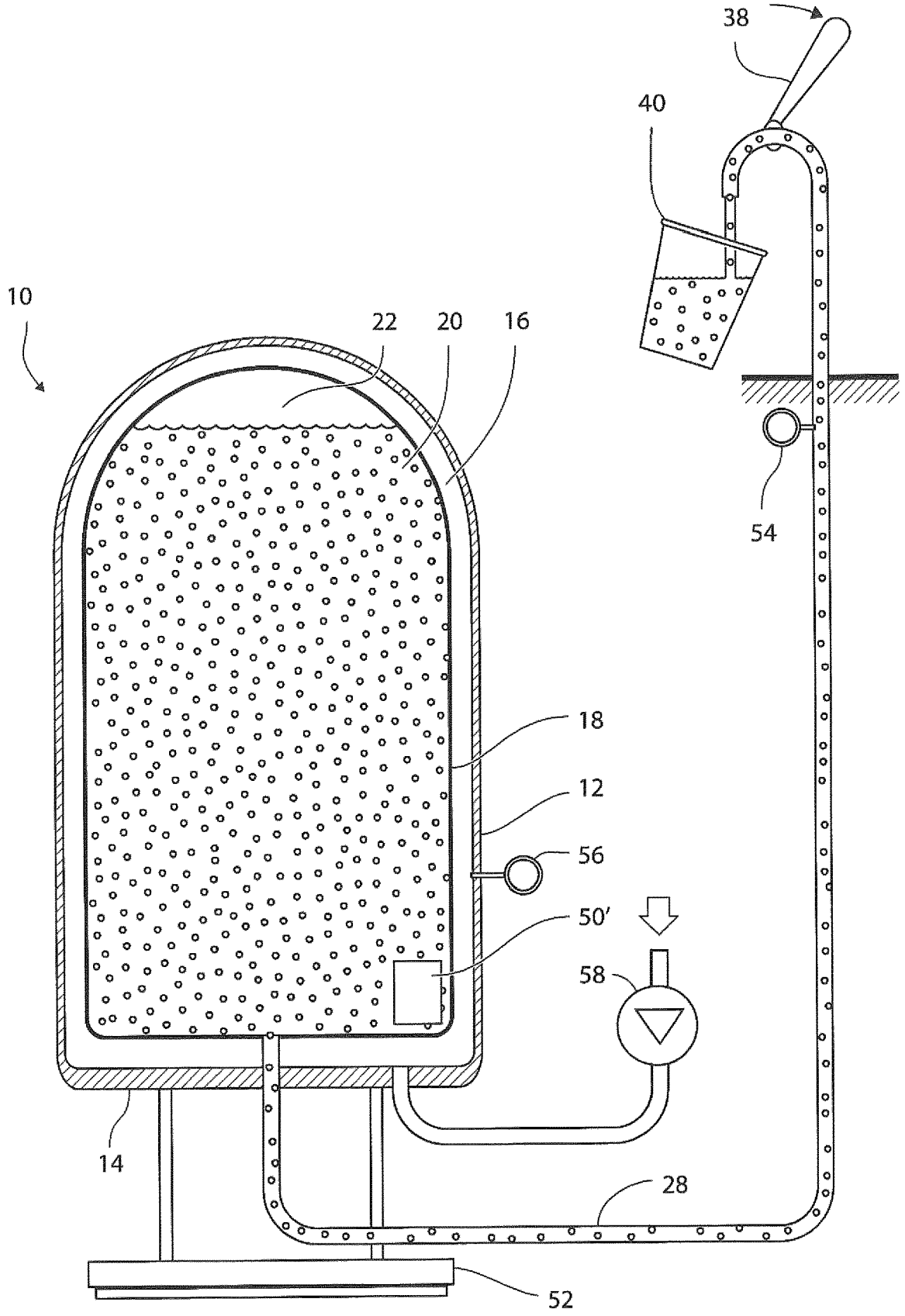
FIG. 3 is a beverage dispensing system having a flexible pressure chamber including a beverage filled keg and weight- and pressure sensors.

FIG. 3 shows a schematic representation of beverage dispensing system 10' comprising a single collapsible beverage container contained in the inner space 16 created by the sealing of lid 12 and base part 14, tapping line 28 and tapping device 34, as described in connection with FIG. 1.

The base part 14 is also connected to a pressure source, such as an air compressor 58. The compressor 58 enables pressurizing the sealed inner volume 16 between the beverage container 18 and the pressure chamber comprising lid 12 and base part 14. When the tapping device 28 is enabling beverage flow, the pressure applied onto the beverage container 18 will result in its gradual collapse, as beverage is forced out of the beverage container 18 and towards the tapping device 28.

The beverage dispensing system 10' includes a weight sensor 52 and optionally a pressure sensor 54. The weight sensor 52 may be used in order to establish the volume of remaining beverage in the beverage container 18 and the flow of beverage through the tapping device 28. The beverage container 18 includes a digital identifier, such as an RFID tag 50 which is readable by an RFID sensor (not shown) in the pressure chamber or any other suitable location in the beverage dispensing system 10.

The weight sensor 52 derives the volume of remaining beverage as well as the flow of beverage through the tapping device 28 by continuously weighting the beverage container 18 during dispensing. The initial weight, volume and density of the beverage in the beverage container 18 and the container itself may be entered manually or entered by automatic means as explained below. The remaining volume may simply be derived as the initial volume minus the loss of weight of the container 18 divided by the density of the beverage.

The pressure sensor 52 measures the pressure at the junction between the tapping line 28 and the tapping device by means of tapping handle 38. When the tapping handle 38 is in closed position (vertical position), the pressure at the junction between the tapping line 28 and the tapping handle 38 will be equal to the pressure inside the pressure chamber as the system is in steady state, i.e. no beverage is flowing. However, during dispensing, a pressure difference relative to the pressure inside the pressure chamber will be identified by the pressure sensor 54. The pressure difference constitutes the pressure drop along the tapping line 28. This gives a clear indication as to whether beverage is flowing through or not. A second pressure sensor 56 may be provided for continuously measuring the pressure within the inner space 16 during dispensing. A third pressure sensor (not shown) may also be provided for continuously measuring the pressure inside the beverage container. Temperature sensor(s) (not shown) may also be adapted for continuously measuring the temperature of the beverage.

The RFID tag 50 may thus include information about the volume of beverage e.g. in litres, the weight of the beverage container and/or the density of the beverage. The RFID tag 50 may also include information about the kind of beverage, e.g. beer, which kind of beer, e.g. ale, lager etc. and the specification of the beverage, e.g. alcoholic content. This will enable automatic processing of the information. The information may be stored locally or communicated to data logging system at a central data storage location e.g. at the brewery. The flow of beverage and the volume of remaining beverage may be stored as well together with the time and date to enable the generation of statistics for optimizing the supply of beverage from the brewery.

Figure 4:
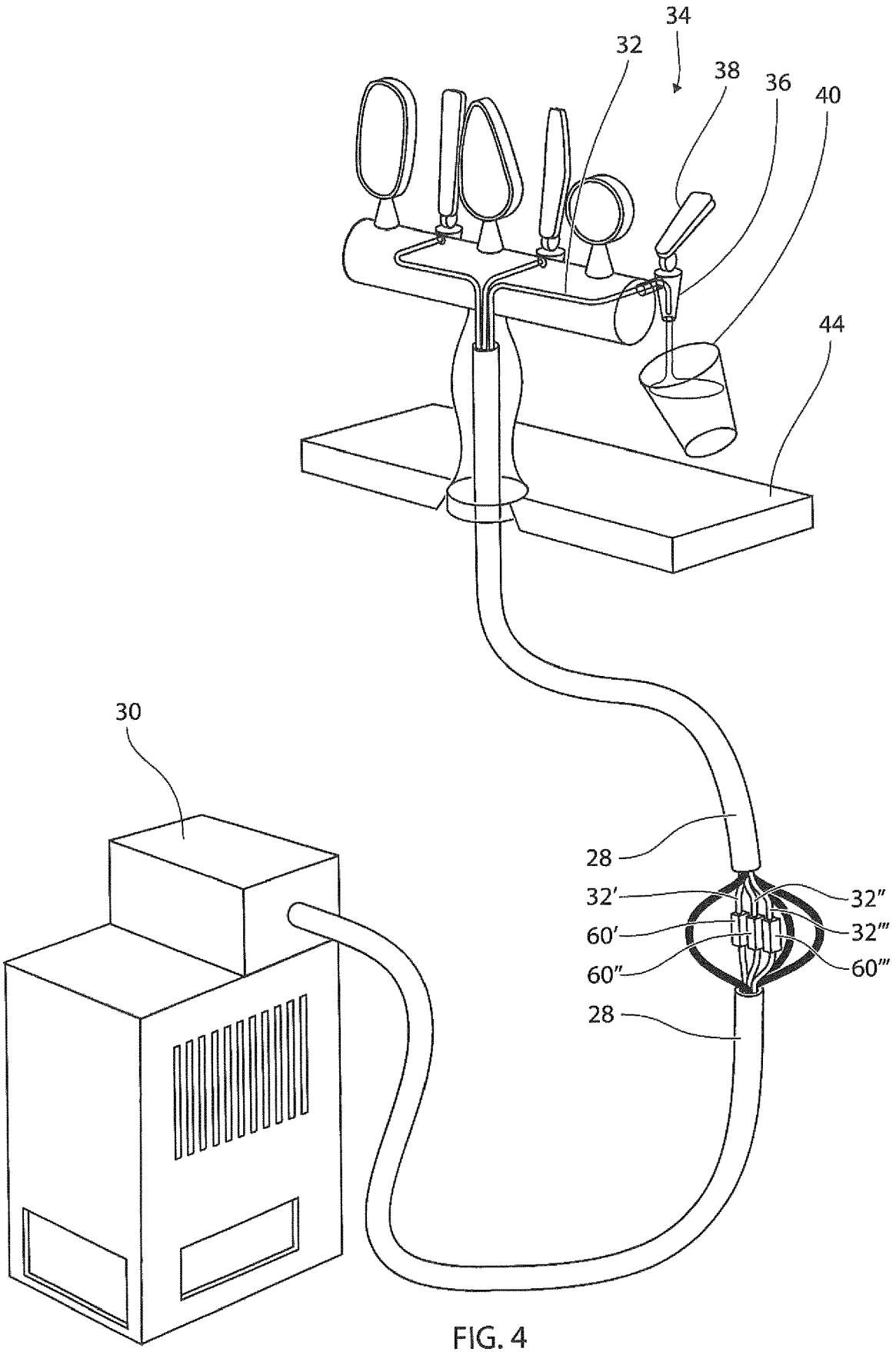
FIG. 4 is an expansion of a portion of the tapping line comprising a combined flow and temperature sensor.

FIG. 4 is an expansion of a portion of the tapping line 28 coming out of the cooling device 30 and including a combined flow and temperature sensor 60', 60", 60'" inserted in each beverage line 32', 32", 32'". Each beverage line carries a given type of beverage. The combined flow and temperature sensor is an ultrasonic measuring device, thus avoiding direct contact with the beverage and provides i.a. time-stamped data login and communication with data logging system (not shown).

Figure 5:
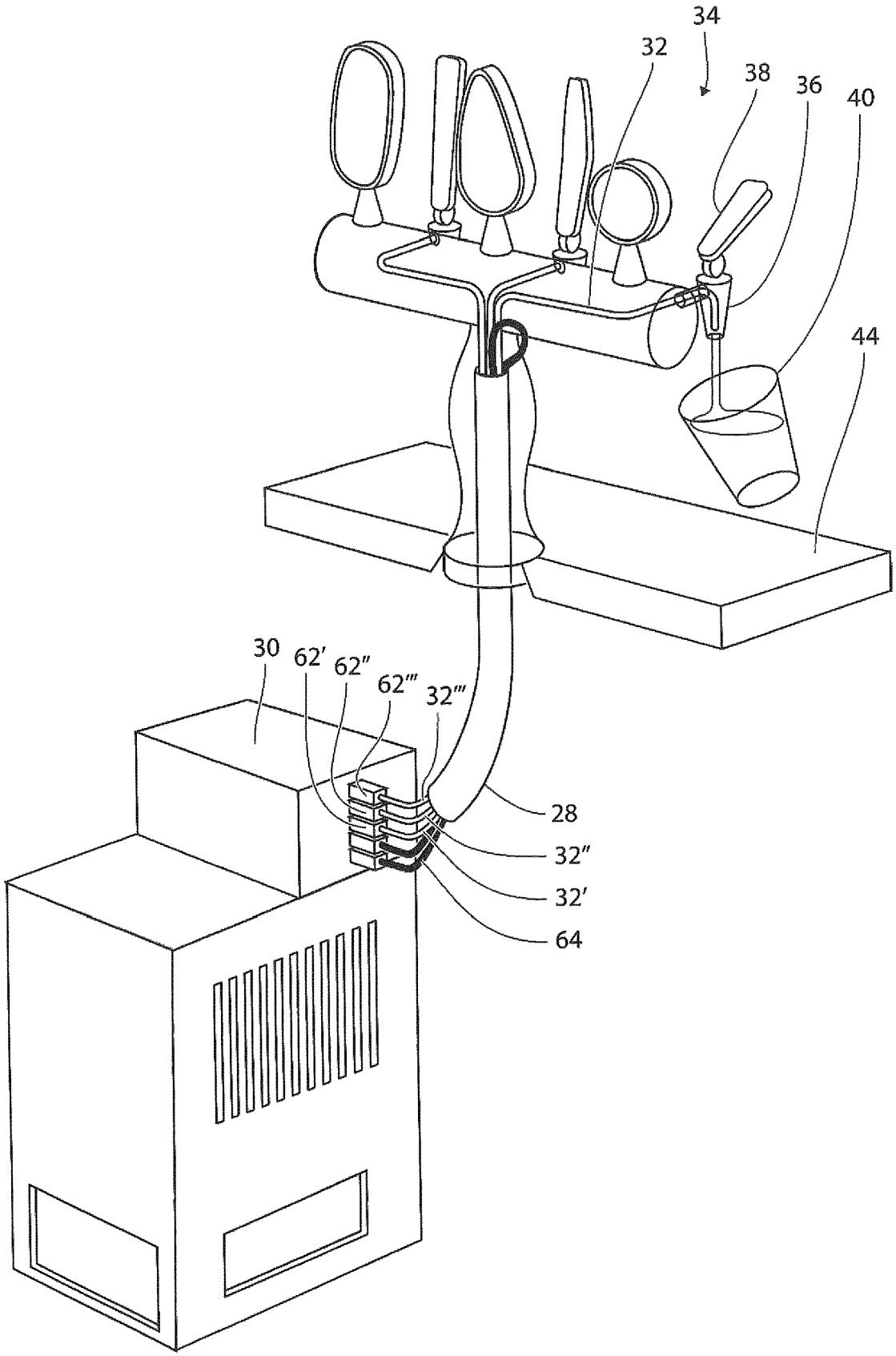
FIG. 5 shows an illustration of temperature sensor units mounted on the cooling device.

FIG. 5 shows an illustration of a particular embodiment of a portion of the beverage dispensing system in which temperature sensors 62 are mounted on (affixed) the cooling device 30 to obtain the temperature of cooling line 64 so that the temperature is measured at the cooling device 30. This enables proper serving temperature in instances where the cooling of the tapping line 28 takes place by a cooling line running adjacent such tapping line (so-called "wet Python"). The serving temperature of the beverage, when this is a beer, is suitably 3-6° C. This serving temperature ($T_{serv}$) may be calculated as the average of the temperature of the cooling line at the point of leaving the cooling device 30 (T1 in ° C.) and its temperature at the point of entering the cooling device 30 when it is returned (T2 in ° C.), i.e. $T_{serv}$=(T1+T2)/2. Temperature T1 is suitably 3 or 4° C. and since T2 is normally above T1, if T1 is above 6° C., this can immediately be detected as an error message, thus indicating the status of the cooling device, here in particular that the cooling device is not working properly. A measuring device, suitably also in the form of temperature a sensor 62 is also mounted on (affixed) the cooling device 30 on any of beverage lines 32 of the tapping line 28.

Figure 6:
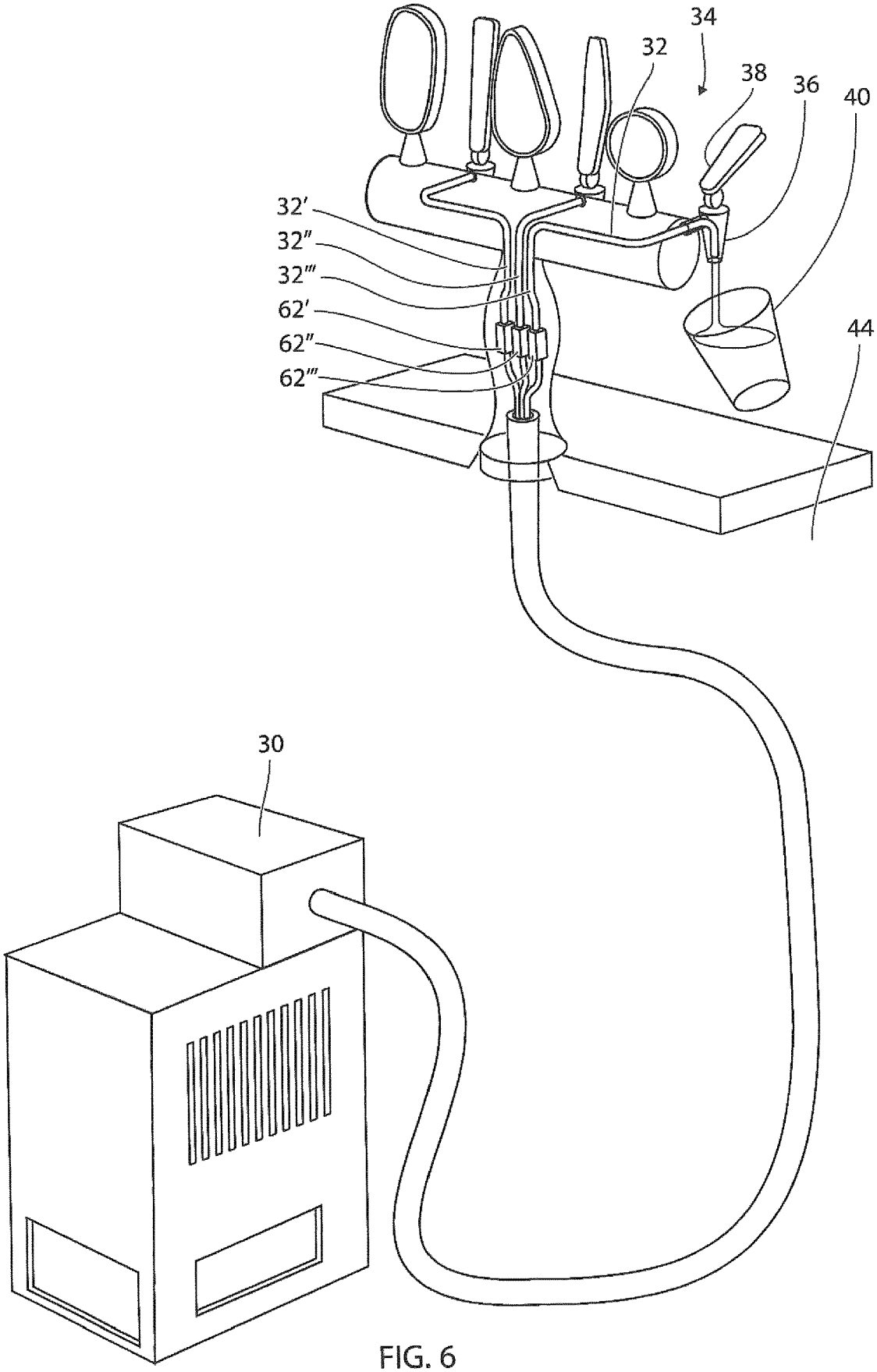
FIG. 6 shows temperature sensor units mounted close to the tapping device.

FIG. 6 shows temperature sensors 62 (62', 62", 62'") mounted in the tapping line in close proximity to said tapping device 34. By close proximity, is meant the last 20%, preferably the last 10% of the length of the tapping line, measured from the cooling device until the tapping handle 38. Here, the cooling of the beverage lines 32', 32", 32'" takes place without the use of a cooling line running adjacent the beverage line (so-called "dry Python"). A font 42 is provided and the temperature sensors 62' are positioned just before the tapping line 28 enters the font.

REFERENCE NUMERALS

10. Beverage dispensing system
12. Flexible lid
14. Base part
16. Inner space
18. Collapsible beverage container
20. Beverage
22. Head space
24. Closure
26. Connector
28. Tapping line
30. Cooling device
32. Beverage line
34. Tapping device
36. Tapping head
38. Tapping handle
40. Beverage recipient (glass)
42. Font
44. Bar counter
46. IR-sensor
48. RFID-reader
50. RFID-tag
52. Weight sensor
54. Pressure sensor
56. Pressure sensor
58. Compressor
60. Combined flow and temperature sensor
62. Temperature sensors
64. Cooling line

The invention claimed is:

1. A beverage dispensing system comprising a collapsible beverage container for dispensing a beverage stored in said collapsible beverage container, said collapsible beverage container defining a beverage filled space, a gas-filled head space and a beverage outlet in communication with said beverage filled space for extracting said beverage from said beverage filled space, said beverage dispensing system comprising:

a base part adapted to cooperate with a beverage container connector for connecting to said beverage outlet of said collapsible beverage container, a tapping device comprising one or more tapping heads for extracting said beverage from said beverage filled space, a tapping line extending from said beverage container connector to said tapping device, said tapping line comprising one or more beverage lines, a lid connectable to said base part, said lid and said base part defining a sealed inner space for accommodating and encapsulating said collapsible beverage container, and a pressure source in fluid communication with said inner space for pressurizing said inner space for applying a force onto said collapsible beverage container, collapsing said collapsible beverage container and forcing said beverage from said beverage filled space through the tapping line and out through the tapping device, wherein said collapsible beverage container includes a measuring device for at least retrieving information about said beverage or said collapsible beverage container, wherein said base part or said lid includes an electronic sensor device for reading said information from said measuring device, thereby establishing digital data representing said information about said beverage or said collapsible beverage container, wherein said measuring device is in the form of a digital sensor in the form of a wireless electronic device, said measuring device is in the form of a visible identifier.

2. The beverage dispensing system according to claim 1, wherein said collapsible beverage container is for single use.

3. The beverage dispensing system according to claim 1, wherein said electronic sensor device is: a digital sensor device for reading said information from said measuring device, is an NFC- or RFID-reader, a bar code reader, or a combination thereof.

4. The beverage dispensing system according to claim 1, wherein said collapsible beverage container includes a closure adapted to cooperate with said beverage container connector, wherein an identification tag is mounted on the rim of said closure, sealing of said closure or internally in said closure, and optionally wherein the identification tag reader is mounted on the base part adjacent to said closure.

5. The beverage dispensing system according to claim 1, wherein a cooling device is adapted downstream said beverage connector and upstream said tapping device for cooling said tapping line, and said cooling device further comprises a measuring device in the form of a temperature sensor for measuring the temperature of a cooling line running adjacent said tapping line and which is mounted on said cooling device.

6. The beverage dispensing system according to claim 1, wherein a cooling device is adapted downstream said beverage connector and upstream said tapping device for cooling said tapping line, wherein said tapping line includes a measuring device in the form of a temperature sensor and the measuring device is mounted in the tapping line in close proximity to said tapping device by being mounted within the last 30% of the length of the tapping line measured from the cooling device until the tapping head of the tapping device.

7. The beverage dispensing system according to claim 1, wherein the tapping line comprises a plurality of beverage lines, each beverage line corresponding to a specific beverage type and adapted to cooperate with a tapping head of the tapping device, each tapping head corresponding to said beverage type, and in which said beverage line includes a measuring device in the form of a flow sensor, temperature sensor, or a combined flow and temperature sensor.

8. The beverage dispensing system according to claim 1, wherein said base part includes a weighing device, for continuously weighing said beverage container during dispensing and establish digital data representing a weight of said beverage container and a flow of beverage through said tapping device deduced via said weight.

9. The beverage dispensing system according to claim 1, wherein said beverage dispensing system comprises:

a first pressure sensor for continuously measuring a first pressure within said inner space during dispensing, a second pressure sensor for continuously measuring a second pressure at said tapping device during dispensing, and a digital processing unit for establishing digital data representing a flow of beverage from said beverage filled space through said tapping line and tapping device, deduced via said first pressure and said second pressure.

10. The beverage dispensing system according to claim 9, further comprising a third pressure sensor for continuously measuring the pressure inside said beverage container.

11. The beverage dispensing system according to claim 1, wherein said tapping head includes a beverage dispensing control means and a spout for dispensing beverage into a beverage recipient, wherein said tapping head is part of a beverage font, said beverage font being mounted in a bar counter, said bar counter defining an operator side and a customer side opposite said operator side, said beverage dispensing system further including a measuring device in the form of a non-contact measuring device which is integrated in said beverage font and is adapted to detect a parameter or property of said beverage recipient.

12. The beverage dispensing system according to claim 11, wherein said non-contact measuring device is a digital sensor in the form of an infrared sensor.

13. The beverage dispensing system according to claim 1, wherein said beverage dispensing system includes a data logging system for retrieving and storing said digital data.

14. A collapsible beverage container for use in the beverage dispensing system according to claim 1, the collapsible beverage container comprising a collapsible body and a closure with a beverage outlet configured for engagement with the beverage container connector of the beverage dispensing system, the collapsible beverage container further comprising at least one identification tag mounted on a rim of said closure, a sealing of said closure or internally in said closure, or on the body of said container, said identification tag readable by a corresponding reader in the beverage dispensing system.

15. The collapsible beverage container according to claim 14, wherein the identification tag is a radio frequency identification tag, a visible/optical tag, or a combination thereof.

16. The collapsible beverage container according to claim 14, wherein the identification tag comprises identification information for uniquely identifying said container.

17. The collapsible beverage container according to claim 14, wherein the identification tag comprises information selected the group of: type of the beverage, producer of beverage, origin of beverage, production date of beverage, production place of beverage and shipping date of beverage.

18. The collapsible beverage container according to claim 14, wherein the identification tag comprises at least one of one or more predefined codes for approval by the beverage dispensing system.

19. A kit of parts of the beverage dispensing system according to claim 1, wherein the beverage dispensing system is configured such that tapping of beverage from said collapsible beverage container is only possible if a predefined match between an ID tag and an ID reader is achieved.

20. A method of dispensing a beverage stored in a collapsible beverage container in a beverage dispensing system, said collapsible beverage container defining a beverage filled space, a gas-filled head space and a beverage outlet in communication with said beverage filled space for extracting said beverage from said beverage filled space, the method comprising:

providing a base part including a beverage container connector for connecting to said beverage outlet of said collapsible beverage container, providing a tapping device comprising one or more tapping heads for extracting said beverage from said beverage filled space, providing a tapping line extending from said container connector to said tapping device, said tapping line comprising one or more beverage lines, providing a lid connectable to said base part, said lid and said base part defining an inner space for accommodating said collapsible beverage container, and accommodating and encapsulating said collapsible beverage container, and providing a pressure source in fluid communication with said inner space for pressurizing said inner space for applying a force onto said collapsible beverage container, collapsing said collapsible beverage container and forcing said beverage from said beverage filled space through the tapping line and out through the tapping device, the method further comprising:

installing in said collapsible beverage container a measuring device for at least retrieving information about said beverage or said collapsible beverage container, wherein said measuring device is in the form of a digital sensor, and said digital sensor being a wireless electronic device, said measuring device is in the form of a visible identifier, and installing in said base part or said lid, an electronic sensor device, adapted to at least reading said information from said measuring device, thereby establishing digital data representing said information about said beverage or said collapsible beverage container.

* * * * *